US008898914B2

(12) United States Patent
Bruder et al.

(10) Patent No.: US 8,898,914 B2
(45) Date of Patent: Dec. 2, 2014

(54) BOW AND ARROW LONG-RANGE SIGHTING DEVICE AND SYSTEM

(76) Inventors: Lane Bruder, Stillwater, OK (US); Victor Borland, Stillwater, OK (US)

( * ) Notice: Subject to any disclaimer, the term of this patent is extended or adjusted under 35 U.S.C. 154(b) by 291 days.

(21) Appl. No.: 13/537,786

(22) Filed: Jun. 29, 2012

(65) Prior Publication Data

US 2013/0000135 A1 Jan. 3, 2013

Related U.S. Application Data

(60) Provisional application No. 61/503,385, filed on Jun. 30, 2011, provisional application No. 61/531,271, filed on Sep. 6, 2011.

(51) Int. Cl.
*F41G 1/467* (2006.01)

(52) U.S. Cl.
CPC ..... *F41G 1/467* (2013.01)
USPC ..... 33/265; 124/87

(58) Field of Classification Search
USPC ..... 33/265; 124/87, 90
See application file for complete search history.

(56) References Cited

U.S. PATENT DOCUMENTS

| | | | | | |
|---|---|---|---|---|---|
| 3,703,770 | A * | 11/1972 | Sofield | 33/265 |
| 4,656,746 | A * | 4/1987 | Gillespie | 33/265 |
| 4,656,747 | A * | 4/1987 | Troncoso | 33/265 |
| 4,656,994 | A * | 4/1987 | Jenks | 124/23.1 |
| 5,148,603 | A * | 9/1992 | Beutler | 33/265 |
| 5,450,673 | A * | 9/1995 | Denton | 33/265 |
| 5,802,726 | A * | 9/1998 | Trosper et al. | 33/265 |
| 6,058,921 | A * | 5/2000 | Lawrence et al. | 124/87 |
| 6,131,295 | A * | 10/2000 | Cranston | 33/265 |
| 6,628,464 | B1 * | 9/2003 | Johnson | 359/894 |
| 6,860,021 | B1 * | 3/2005 | Connelly, III | 33/265 |
| 7,805,847 | B2 * | 10/2010 | Behr | 33/265 |

* cited by examiner

*Primary Examiner* — Christopher Fulton
(74) *Attorney, Agent, or Firm* — Hall Estill Law Firm

(57) ABSTRACT

This disclosure relates to a long-range sighting device for an archer's bow. The long-range sighting device including a strip of material having a length, a width, a perimeter and a plurality of holes disposed therein, wherein the strip of material is supportable by a string of a bow.

5 Claims, 7 Drawing Sheets

BOW AND ARROW LONG-RANGE SIGHTING DEVICE AND SYSTEM

CROSS-REFERENCE TO RELATED APPLICATIONS

The present application claims the benefit under 35 U.S.C. §119(e) of U.S. Provisional application Ser. No. 61/503,385, filed Jun. 30, 2011, entitled "Bow and Arrow Long-Range Sighting System" and U.S. Provisional Application Ser. No. 61/531,271, filed Sep. 9, 2011, entitled "Bow and Arrow Long-Range Sighting System", both of which are hereby expressly incorporated herein in their entirety.

STATEMENT REGARDING FEDERALLY SPONSORED RESEARCH OR DEVELOPMENT

Not applicable.

BACKGROUND OF THE INVENTION

1. Field of the Invention

The present invention relates to a sighting and/or targeting device and a bow (bow and arrow) to enable efficient targeting at longer distances.

2. Description of the Related Art

Traditionally, compound bows are equipped with up to 5 pins and a peep sight for targeting objects less than about 60 yards away. Archers would have to alter their shooting technique or form to target objects farther than 60 yards. Accordingly, there is a need for a sighting/targeting device for a bow to permit the launching of an arrow at distances significantly longer than 60 yards without altering an archer's shooting technique or form.

DETAILED DESCRIPTION OF THE INVENTION

Figure 1:
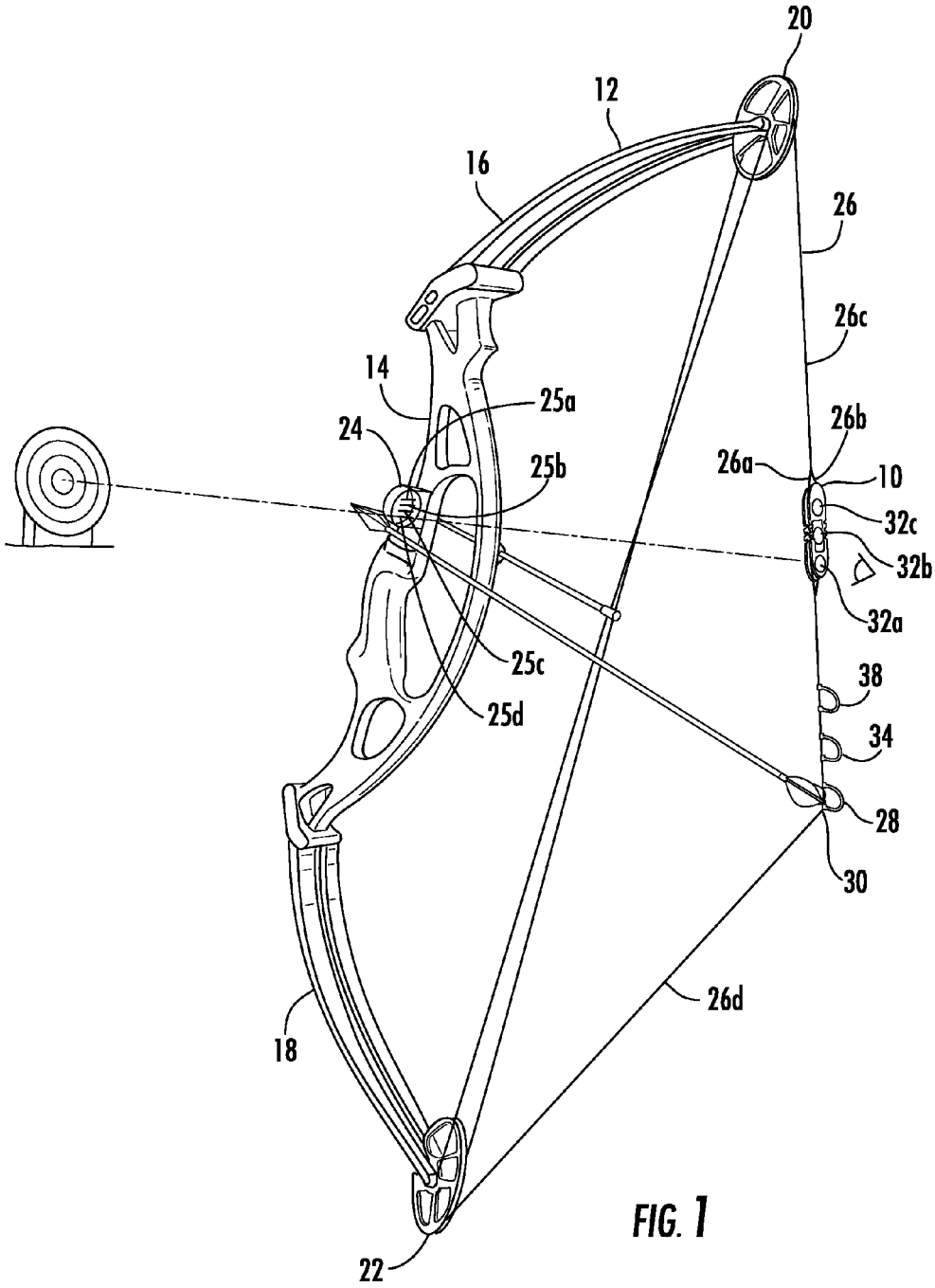
FIG. 1 provides a perspective view of one embodiment of a long-range targeting device and bow constructed in accordance with the present invention.

The present invention is related to a long-range sighting device 10 (or targeting device or multiple peep sight) for a compound bow 12. A compound bow 12, as shown in FIG. 1, typically includes a riser 14, a first limb 16 attached to the riser 14, a second limb 18 attached to the riser 14, a first cam 20 attached to the first limb 16, a second cam 22 attached to the second limb 18, sighting pin apparatus 24 and a string 26. The sighting pin apparatus 24 provided with a plurality of sighting pins 25*a*, 25*b*, 25*c* and 25*d*. It should be understood and appreciated that either one of the cams 20 and 22 could be an idler and, while four sighting pins 25*a*-25*d* are shown, there could be more or less. The bow 12 can include a first D-ring 28 supported by the string 26 to define a first draw point 30 of the bow 12. It should be understood and appreciated that the bow 12 does not have to be equipped with a D-ring for drawing the string 26 back. The string 26 can be equipped with anything known in the art, or nothing at all, to establish the draw point 30.

The first draw point 30 or the first D-ring 28 will be where an arrow is fired from for all embodiments of the present invention. The draw points may change but the arrow is notched from the first draw point 30.

Figure 2:
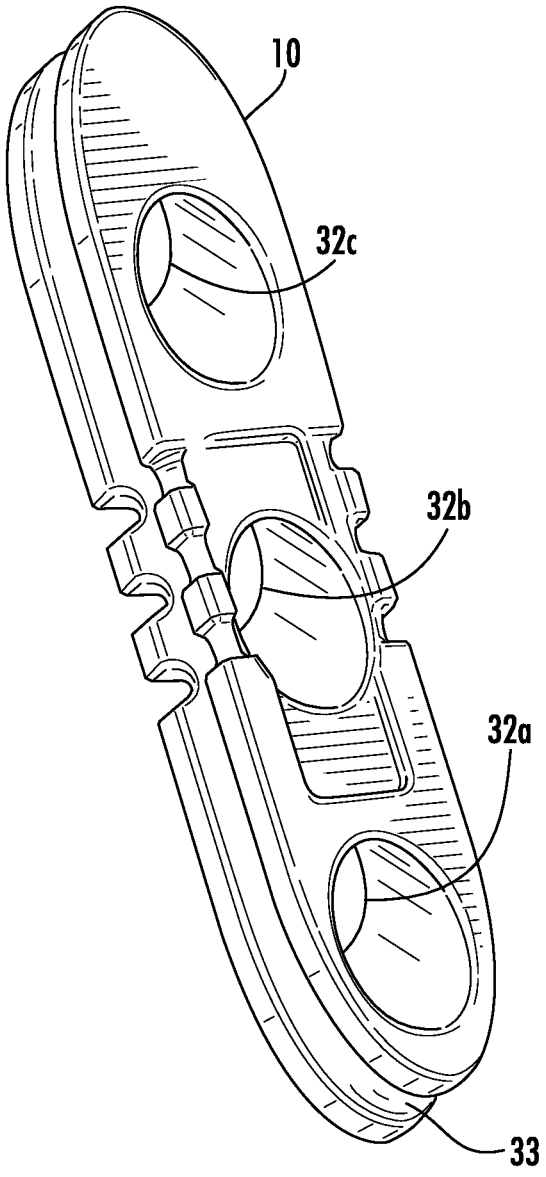
FIGS. 2-2D provides various views of one embodiment of the long-range targeting device constructed in accordance with the present invention.
Figure 2A:
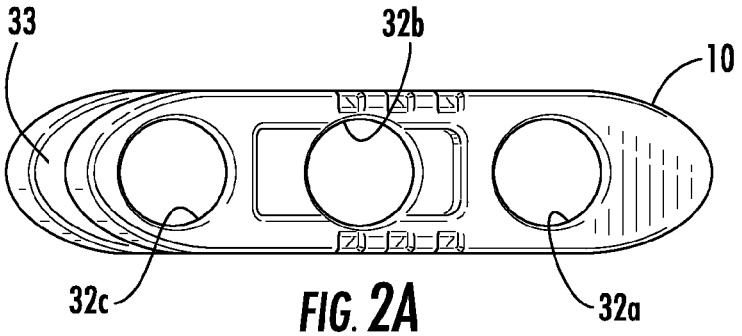
Figure 2B:
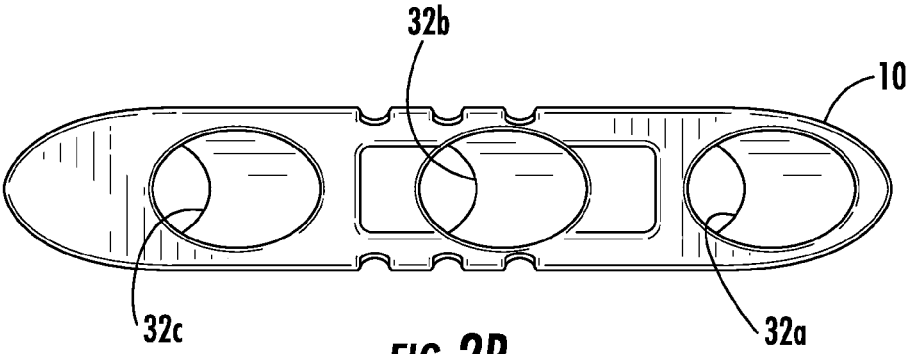
Figure 2C:
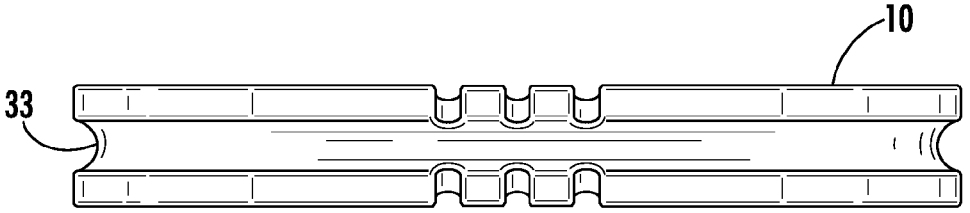
Figure 2D:
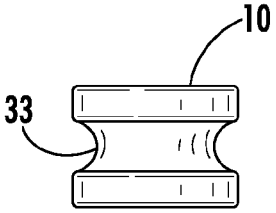
Figure 3:
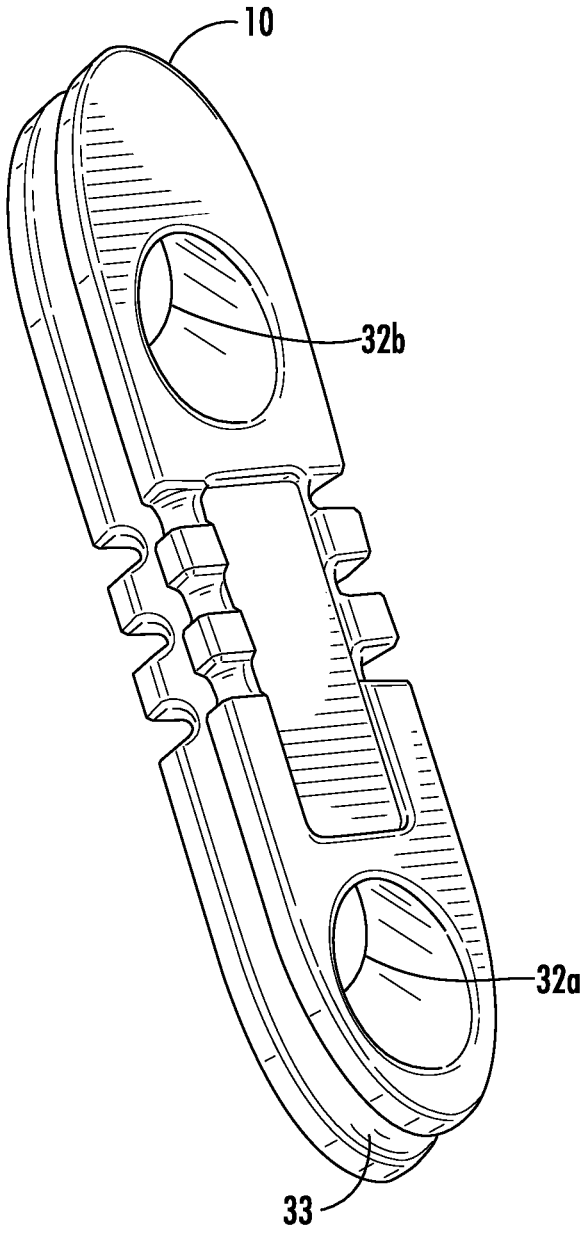
FIG. 3 provides a view of another embodiment of the long-range targeting device constructed in accordance with the present invention.

In one embodiment of the present invention and shown in FIGS. 2-2*d*, the long-range sighting device 10 is a strip of material having a length and a width that includes a first sight hole 32*a*, a second sight hole 32*b* and a third sight hole 32*c*. FIG. 3 shows another embodiment of the present invention. In this embodiment, the long-range sighting device 10 includes the first sighting hole 32*a* and the second sighting hole 32*b*. It should be understood that the long-range sighting device 10 is not limited to any certain number of sighting holes 32. In another embodiment, the long-range sighting device 10 includes a concave edge 33 running around a substantial portion of the long-range sighting device's 10 perimeter. In another embodiment, sections of the string 26 can be divided into a first string portions 26*a* and a second string portion 26*b*. The concave edge 33 of the long-range sighting device 10 can receive the first and second string portion 26*a* and 26*b* of the string 26. The string portions 26*a* and 26*b* are positioned in the concave edge 33 of the long-range sighting device 10 to prevent the long-range sighting device 10 from moving. It should be understood and appreciated that the long-range sighting device 10 can be disposed and/or supported by the string 26 in any manner known in the art. For example, the long-range sighting device 10 could be tied in, clamped in, etc.

It should be understood and appreciated that the strip of material can be a single piece of material, or can be constructed of multiple pieces of materials. It should be understood and appreciated that the long-range sighting device 10 can be constructed of any material known in the art capable of withstanding the wear and tear to which a bow is typically accustomed. For example, the long-range sighting device 10 can be constructed of, but not limited to, any polymer material, wood, plastic, carbon fiber, a lightweight metal, a metal material, and the like.

In another embodiment, the sighting holes 32*a*, 32*b* and 32*c* are disposed in the long-range sighting device 10 in a line substantially along a center line along the length of the long-range sighting device 10. The spacing between the sighting holes can vary depending upon the desired longer distances that the archer prefers.

In another embodiment, the sighting holes 32 of the long-range sighting device 10 are angled upward in the direction away from an archer and towards the riser 14 of the bow 12 when the string 26 is in an undrawn position. When the string 26 of the bow 12 is drawn by the archer, the string 26 is divided into two parts, a top string part 26*c* and a bottom string part 26*d*. The top string part 26*c* extends upwardly and at an angle from the first draw point 30 to the first cam 20. When the string 26 is drawn, the top string part 26*c* is angled, and the long-range sighting device 10 is in place, the sighting holes 32 are then substantially perpendicular to the line of sight of the archer drawing the string 26 of the bow 12.

Figure 4A:
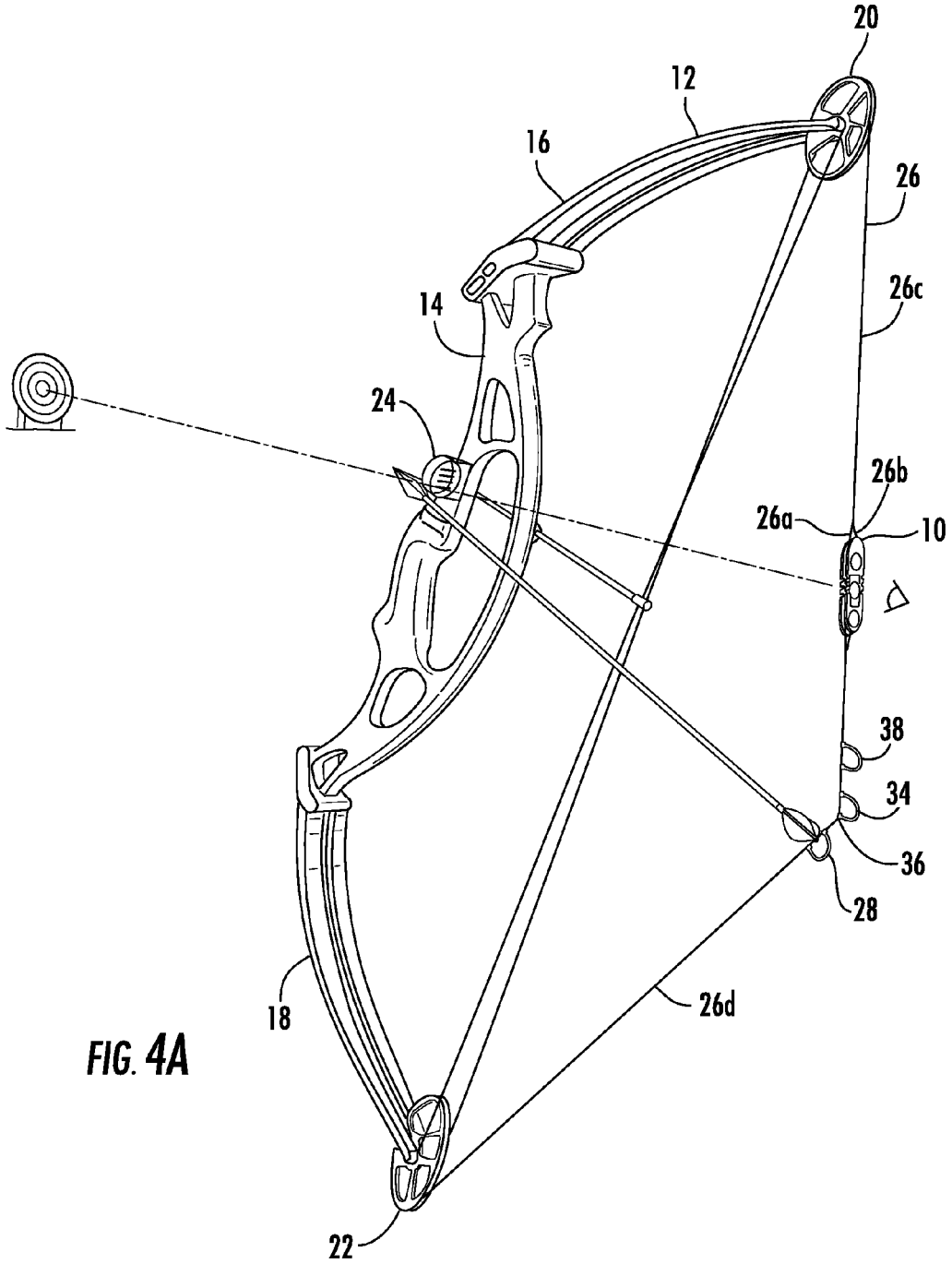
FIGS. 4A-4B provides perspective views further embodiments of the long-range targeting device and bow constructed in accordance with the present invention.

As depicted in FIG. 1, an archer desirous of a typical length shot of approximately 20-50 yards and implementing the long-range sighting device 10 and the bow 12 can draw the string 26 back using the first D-ring 28 to create a sight line from the archer's eye through the first sight hole 32*a* of the long-range sighting device 10 to the sighting pin apparatus 24 (and sighting pins 25*a*-25*d*). For a longer shot, the bow 12 can include a second D-ring 34 disposed above the first D-ring 28 and supported by the string 26. The second D-ring 34 defines a second draw point 36 for the bow 12. For this longer shot, the archer can draw the string 26 back using the second D-ring 34 to create a sight line from the archer's eye through the second sight hole 32*b* of the long-range sighting device 10 to the sighting pin apparatus 24 (and sighting pins 25*a*-25*d*). This embodiment is depicted in FIG. 4*a*.

Figure 4B:
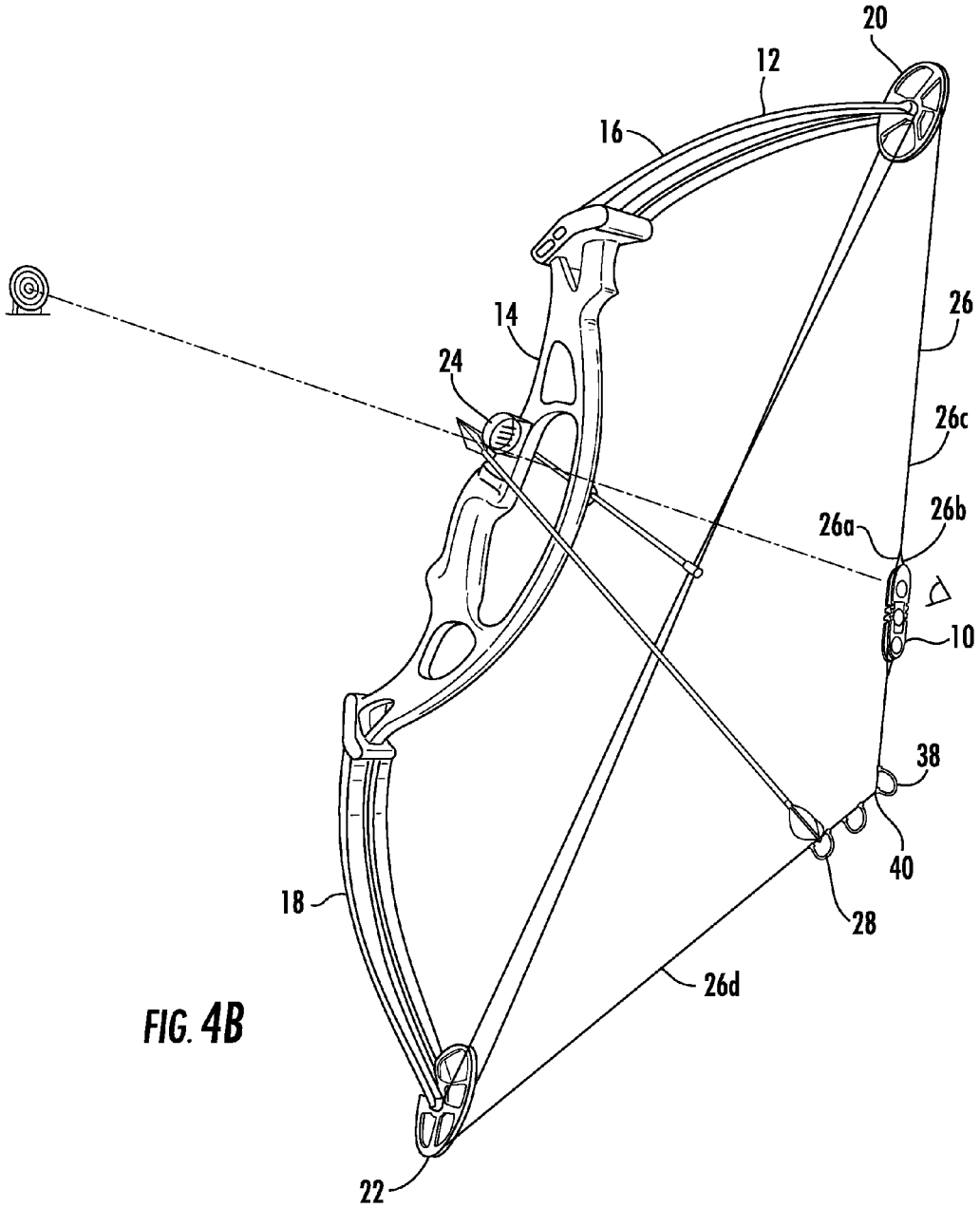

In a further embodiment of the present invention, the long-range sighting device 10 can be used to make an even longer shot. For the even longer shot, the bow 12 can include a third D-ring 38 disposed above the second D-ring 34 and supported by the string 26. The third D-ring 38 defines a third draw point 40 for the bow 12. For this even longer shot, the archer can draw the string 26 back using the third D-ring 38 to create a sight line from the archer's eye through the third sight hole 32*c* of the long-range sighting device 10 to the sighting pin apparatus 24 (and sighting pins 25*a*-25*d*). This embodiment is depicted in FIG. 4*b*.

When the long-range sighting device 10 is used to shoot arrows longer than typical distances, the bow 12 will be tilted back toward the archer when using sighting hole 32*b* or 32*c* of the long-range sighting device 10.

Figures 5A, 5B, 5C:
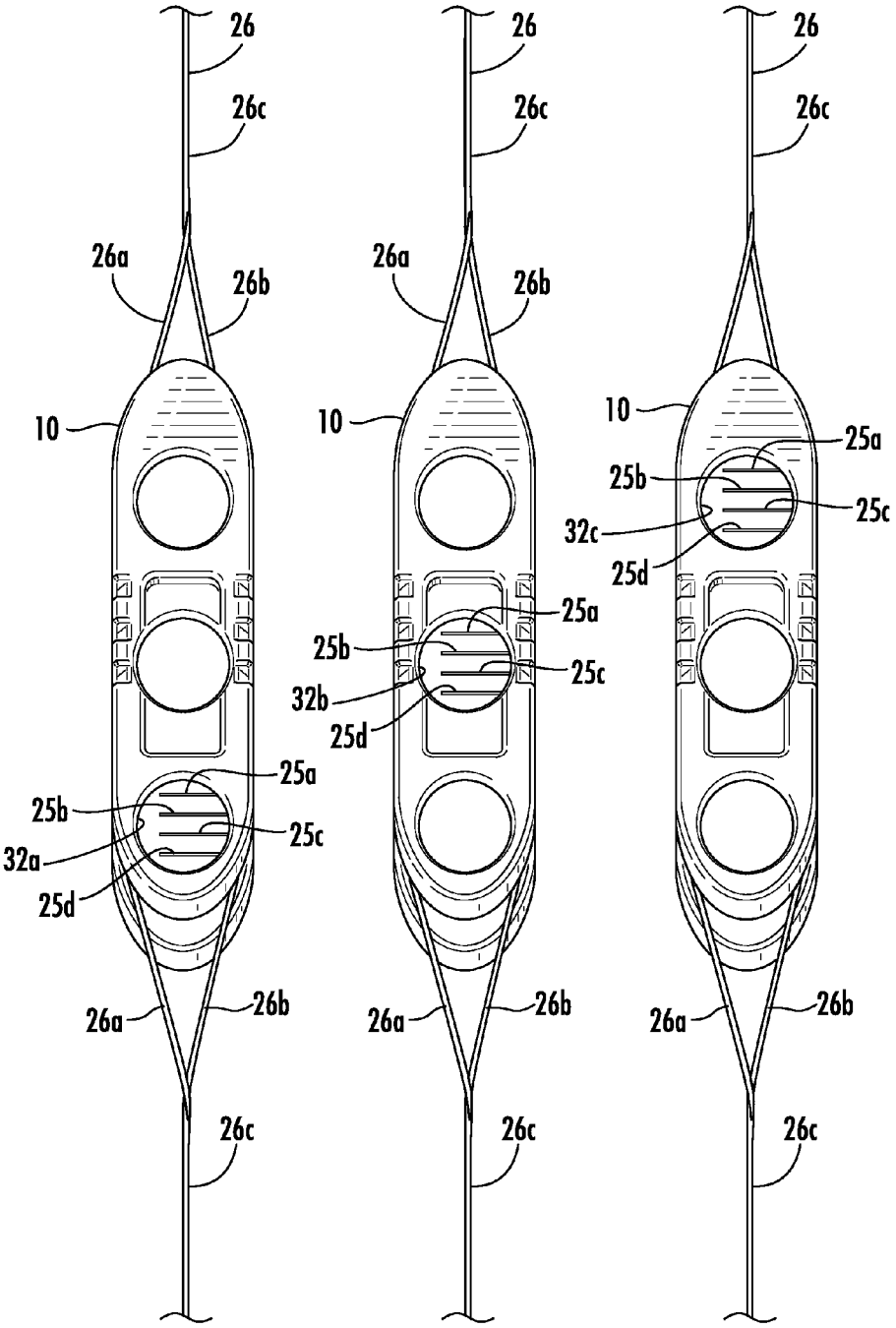
FIGS. 5A-5C provides perspective views of various embodiments of the long-range targeting device in use and constructed in accordance with the present invention.

FIGS. 5*a*, 5*b* and 5*c* show the sighting pin apparatus 24 and sighting pins 25*a*-25*d* through the sighting holes 32*a*, 32*b* and 32*c*, respectively. These views show the sighting holes 32 being substantially perpendicular to the archer's line of sight and show the long-range sighting device 10 being angled away from the archer due to the drawing of the string 26 which causes the top string part 26 to be angled up and away from the archer.

When using the long-range sighting device 10 and the bow 12, the archer selects a target and determines a distance to the target. The archer then selects the D-ring (or draw point) associated with the sighting hole in the long-range sighting device 10 for the distance of the target. The archer will then draw the string 26 back from the appropriate D-ring (or draw point), look through the appropriate sighting hole for that distance to view the sighting pin apparatus 24. At this point, the archer will then pick the sighting pin 25 associated with the exact distance he estimates the target to be. The archer then shoots the bow 12 in the typical manner that a bow is shot.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

The invention claimed is:

1. An archery kit including a bow and a long-range sighting device, the kit comprising:

a bow having a riser, a first limb attached to the riser, a second limb attached to the riser, a first cam attached to the first limb, a second cam attached to the second limb, a sighting pin apparatus supported by the bow, a string attached to the first and second limbs and wound around the first and second cams, the sighting pin apparatus having at least one sighting pin attached thereto, the string having a plurality of draw points, the draw points of the string are D-shaped rings of material attached to the string; and a strip of material having a length, a width, a perimeter and a plurality of holes disposed therein wherein the strip of material is supportable by the string of the bow.

2. The kit of claim 1 wherein the strip of material having a concave edge disposed around a substantial portion of the perimeter of the strip of material to receive portions of the string of the bow.

3. The kit of claim 1 wherein the plurality of holes disposed in the strip of material are angled towards one end of the strip of material.

4. The kit of claim 1 wherein the plurality of holes disposed in the strip of material is selected from the group consisting of two holes and three holes.

5. The kit of claim 1 wherein the plurality of holes disposed in the strip of material are disposed in a line substantially along a center line of the length of the strip of material.

* * * * *